US010773173B1

(12) United States Patent
Bagumyan et al.

(10) Patent No.: US 10,773,173 B1
(45) Date of Patent: Sep. 15, 2020

(54) INFLATABLE STRUCTURE WITH DRAIN SYSTEM

(71) Applicants: Sarmen Bagumyan, Sun Valley, CA (US); Arthur Bagumyan, Sun Valley, CA (US); Andranik Andy Bagumyan, Sun Valley, CA (US)

(72) Inventors: Sarmen Bagumyan, Sun Valley, CA (US); Arthur Bagumyan, Sun Valley, CA (US); Andranik Andy Bagumyan, Sun Valley, CA (US)

( * ) Notice: Subject to any disclaimer, the term of this patent is extended or adjusted under 35 U.S.C. 154(b) by 0 days.

(21) Appl. No.: 16/668,872

(22) Filed: Oct. 30, 2019

(51) Int. Cl.
*A63G 31/12* (2006.01)

(52) U.S. Cl.
CPC ..... *A63G 31/12* (2013.01)

(58) Field of Classification Search
CPC ..... A63G 31/00; A63G 31/12; A47C 27/081; A47C 27/083; A47C 31/105; A61G 7/05769; A61G 7/1021; A63H 27/10; A63H 2027/1041; A63H 27/1033; A63H 3/06
USPC ..... 472/134; 5/655.3, 652.1, 671, 706, 945; 446/220, 222; 24/580.1, 580.11
See application file for complete search history.

(56) References Cited

U.S. PATENT DOCUMENTS 8,177,828 B2 * 5/2012 Anderson ..... A61F 7/0097 5/706
2006/0225218 A1 * 10/2006 Zheng ..... A47C 27/10 5/655.5
2011/0297247 A1 * 12/2011 Deutsch ..... A47C 27/081 137/233
2014/0033440 A1 * 2/2014 Tyree ..... A47C 27/148 5/706
2015/0148141 A1 * 5/2015 Thompson ..... A63G 31/12 472/134

OTHER PUBLICATIONS

Author: Unknown. Title: Pogo Bounce House, date unknown, https://www.pogobouncehouse.com/accessory-rain-drain-for-inflatables.

* cited by examiner

*Primary Examiner* — Kien T Nguyen
(74) *Attorney, Agent, or Firm* — Eric Karich; Karich & Associates

(57) ABSTRACT

An inflatable structure has an air mattress capable of sustaining an air pressure, and having a mattress aperture through a side wall of the air mattress. The inflatable structure further includes a panel secured with fasteners for fastening the first pair of opposing edges to the air mattress such that a panel aperture is positioned over the mattress aperture. Finally, the inflatable structure includes an elongate sheet having a sheet aperture. The elongate sheet is slidably mounted between the panel and the air mattress so that the elongate sheet may slide between a closed position wherein the elongate sheet covers the mattress aperture to provide a seal over the air mattress, and an open position wherein the sheet aperture is aligned with the mattress aperture and the panel aperture, thereby permitting air/water to drain out of the air mattress.

4 Claims, 2 Drawing Sheets

INFLATABLE STRUCTURE WITH DRAIN SYSTEM

BACKGROUND OF THE INVENTION

Field of the Invention

This invention relates generally to inflatable structures, and more particularly to drains, for air and water, for inflatable structures.

Description of Related Art

The prior art shows some examples of drains for inflatables, such as those which are glued to a structure and include hook-and-loop fasteners for opening and closing a drain flap. One issue with this type of drain is that the hook-and-loop fasteners tend to wear over time, and eventually will fail to properly contain air within the inflatable device.

The prior art does not teach an inflatables drain which is simple to manufacture and use, and is durable enough for long usage without failure. The present invention fulfills these needs and provides further advantages as described in the following summary.

SUMMARY OF THE INVENTION

The present invention teaches certain benefits in construction and use which give rise to the objectives described below.

The present invention provides an inflatable structure comprising an air mattress capable of sustaining an air pressure, the air mattress having a side wall and a mattress aperture through the side wall of the air mattress. The inflatable structure further has a panel having a first pair of opposing edges, a second pair of opposing edges, and a panel aperture through the panel, and fasteners for fastening the first pair of opposing edges to the air mattress such that the panel aperture is positioned over the mattress aperture. Finally, the inflatable structure includes an elongate sheet having side edges that extend from a first end to a second end, the elongate sheet having a sheet aperture. The elongate sheet is slidably mounted between the panel and the air mattress so that the elongate sheet may slide between a closed position wherein the elongate sheet covers the mattress aperture to provide an airtight seal over the air mattress, and an open position wherein the sheet aperture is aligned with the mattress aperture and the panel aperture, thereby permitting air/water to drain out of the air mattress.

A primary objective of the present invention is to provide an inflatable structure having advantages not taught by the prior art.

Another objective is to provide an inflatable structure which is simply constructed and easy to install.

A further objective is to provide an inflatable structure which is durable.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an inflatable structure with drain for removing water and air from inflatables such as an air mattress, inflatable slide, etc.

Figure 1:
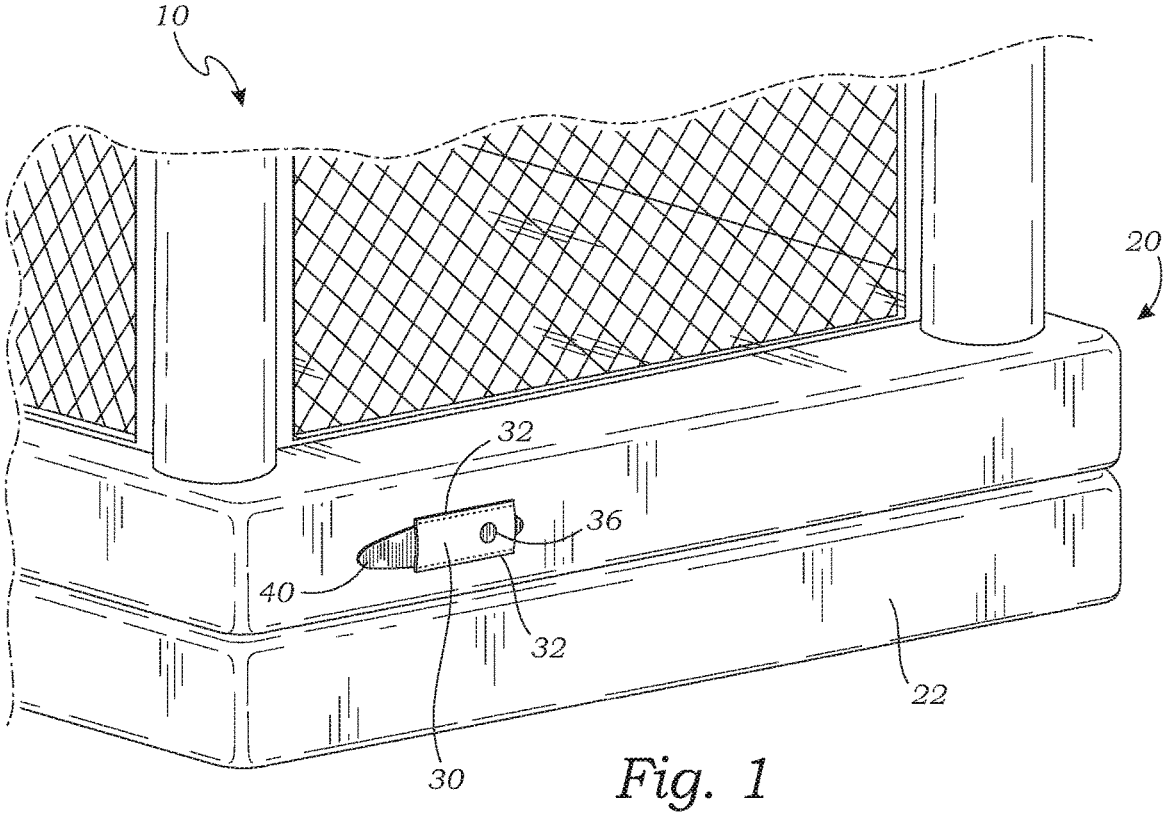
FIG. 1 is a perspective view of an inflatable structure with drain system according to one embodiment of the present invention.
Figure 2:
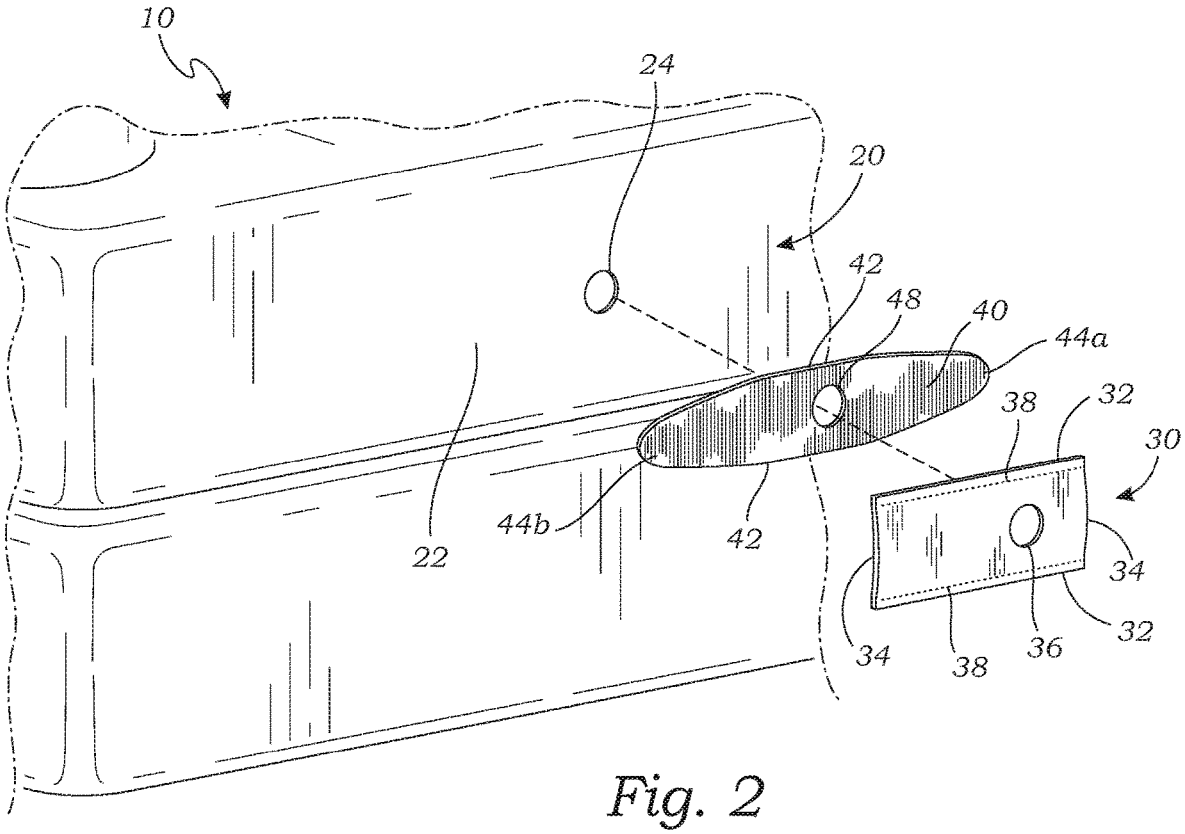
FIG. 2 is an exploded perspective view thereof.

FIG. 1 is a perspective view of the inflatable structure 10 according to one embodiment of the present invention. FIG. 2 is an exploded perspective view thereof. As shown in FIGS. 1-2, the inflatable structure 10 comprises an air mattress 20, a panel 30, and an elongate sheet 40, each described in greater detail herewith. The air mattress 20 is capable of sustaining an air pressure, and has a side wall 22 which includes a mattress aperture 24. For the purposes of this application, "air mattress" is hereby defined to include any inflatable structure including a side wall which may be used to drain air or water, including inflatable slides, bounce-houses, inflatable pool products, or any related products in the field. The term "side wall" is defined to include any location on the air mattress 20, including any location on any side, the top, bottom, or elsewhere deemed suitable by the designer. The air mattress 20 may be manufactured including the mattress aperture 24, or the mattress aperture 24 may be cut into an existing air mattress for use with the present invention.

The panel 30 comprises a first pair of opposing edges 32, a second pair of opposing edges 34, and a panel aperture 36 through the panel 30. The panel 30 may be in the form of a flexible sheet of a variety of materials, e.g., PVC, nylon, vinyl, etc., or any other similar materials known to those skilled in the art. In alternative embodiments, however, the panel 30 may be formed of other materials and structure (e.g., a rigid or semi-rigid sheet or housing, etc.), and any alternatives known to those skilled in the art should be considered within the scope of the present invention.

Figure 3:
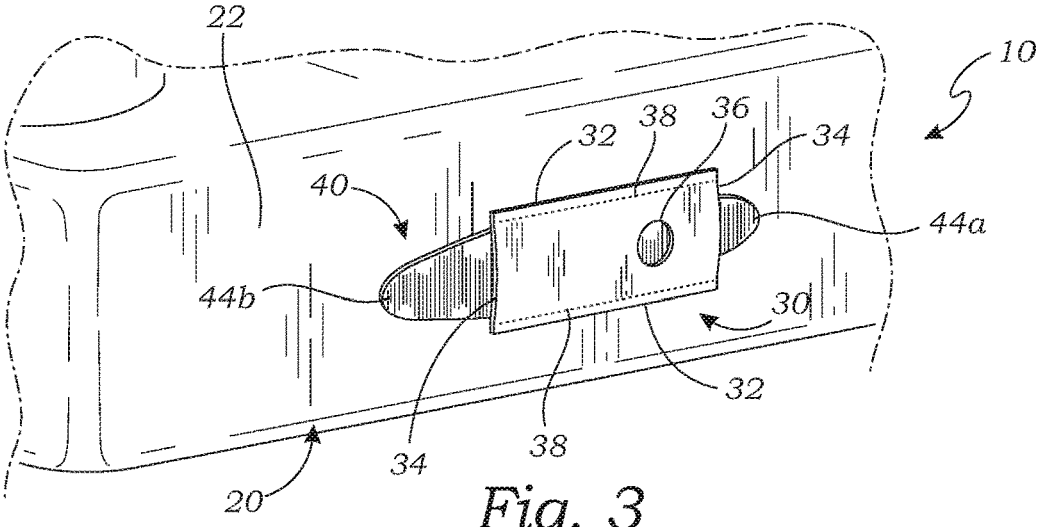
FIG. 3 is a front elevational view thereof, in a closed position.
Figure 4:
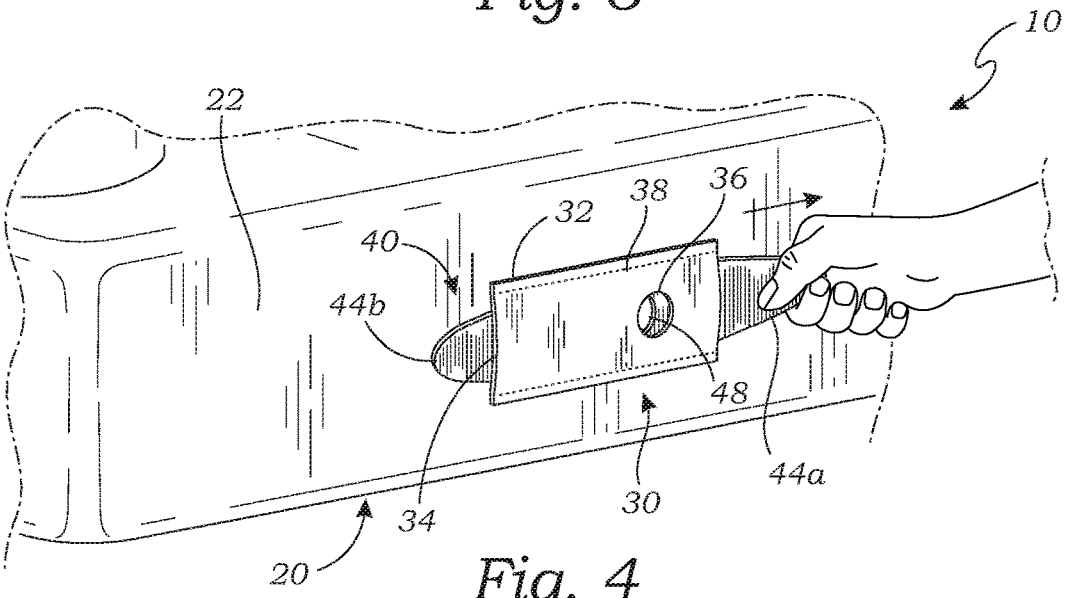
FIG. 4 is a front elevational view thereof, in a partially open position.
Figure 5:
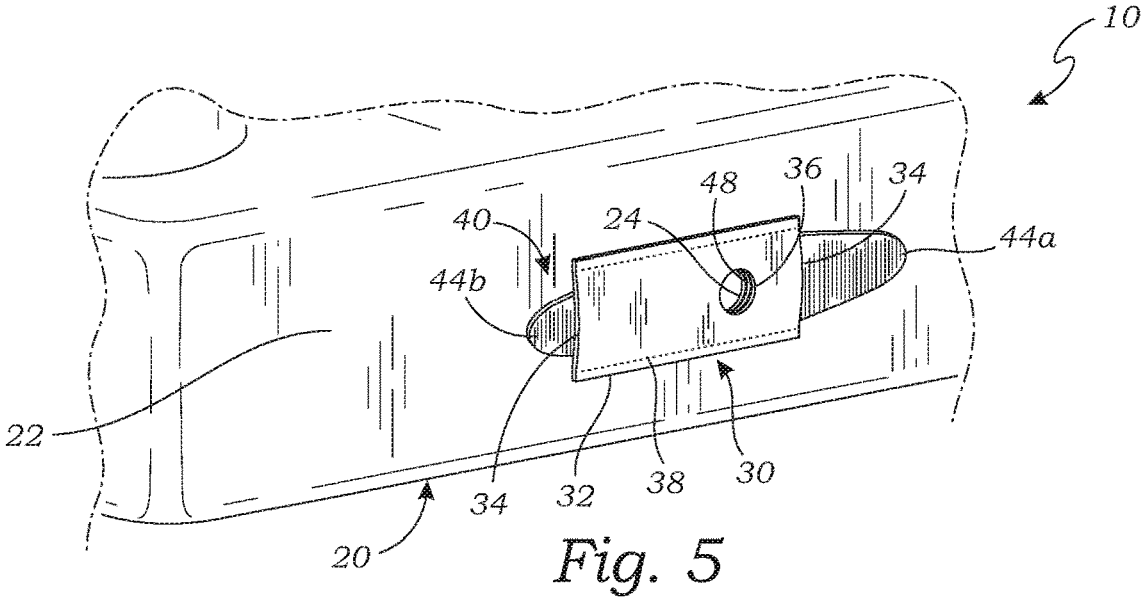
FIG. 5 is a front elevational view thereof, in an open position.

Fasteners 38 may be used for fastening the first pair of opposing edges 32 to the air mattress 20 such that the panel aperture 36 is positioned over the mattress aperture 24 (shown in FIGS. 3-5). In this embodiment, the fasteners 38 are in the form of sewn thread, but in other embodiments, the panel 30 may be glued, welded, fastened (e.g., with mechanical fasteners), or otherwise attached to the air mattress 20. The panel 30 may be generally rectangular, such that the first pair of opposing edges 32 are approximately parallel, explained in greater detail later. The second pair of opposing edges 34 are not attached to the air mattress 20, to allow the elongate sheet 40 to pass between them, as described below.

As shown in FIGS. 1-2, the elongate sheet 40 is intermediate the panel 30 and the air mattress 20, and includes side edges 42 that extend from a first end 44*a* to a second end 44*b*. The elongate sheet 40 may further include a connector, e.g., a ribbon or strap (not shown) for retaining the sheet between the panel 30 and the air mattress 20. The elongate sheet 40 may be constructed of the same or similar material as the panel 30 and the air mattress 20, or be made of any other suitable material known to those in the art. In this embodiment, the first and second ends 44*a* and 44*b* of the elongate sheet 40 taper inwardly from the side edges 42, facilitating movement of the sheet 40 be reducing friction between the sheet 40 and the panel 30. The elongate sheet 40 further has a sheet aperture 48 for selectively allowing air or water to drain out of the mattress aperture 24, the panel aperture 36, and the sheet aperture 48, as elaborated below.

FIG. 3 is a front elevational view of the inflatable structure with drain, showing the whole assembly in a closed position. As shown in FIG. 3, the elongate sheet 40 is slidably mounted between the panel 30 and the air mattress 20 so that the elongate sheet 40 may slide between the closed position, wherein the mattress aperture 24 is covered, and an open position (shown in FIG. 5). In the closed position, the elongate sheet 40 covers the mattress aperture 24 and provides a seal (or at least a partial seal) over the air mattress 20. The panel 30 holds the elongate sheet 40 in place.

FIG. 4 is a front elevational view of the inflatable structure 10, in a partially open position, illustrating a user's hand gripping the first end 44*a* of the elongate sheet 40 to pull the elongate sheet 40 from the closed position to a partially open position, towards the fully open position shown in FIG. 5. In this embodiment, the first pair of opposing edges 32 of the panel 30, and the side edges 42 of the elongate sheet 40 are each approximately parallel, such that the first pair of opposing edges 32 guide the side edges 42, as on a track, when a user pulls the first or second ends 44*a* or 44*b* of the elongate sheet 40 to open or close the inflatable structure with drain 10.

FIG. 5 is a front elevational view of the inflatable structure 10, in the fully open position.

In the open position, the sheet aperture 48 is aligned with the mattress aperture 24 and the panel aperture 36, thereby permitting air/water to drain out of the air mattress 20.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An inflatable structure comprising:

an air mattress capable of sustaining an air pressure, the air mattress having a side wall;

a mattress aperture through the side wall of the air mattress;

a panel having a first pair of opposing edges, a second pair of opposing edges, and a panel aperture through the panel;

fasteners for fastening the first pair of opposing edges to the air mattress such that the panel aperture is positioned over the mattress aperture;

an elongate sheet having side edges that extend from a first end to a second end, the elongate sheet having a sheet aperture; and wherein the elongate sheet is slidably mounted between the panel and the air mattress so that the elongate sheet may slide between a closed position wherein the elongate sheet covers the mattress aperture to provide an airtight seal over the air mattress, and an open position wherein the sheet aperture is aligned with the mattress aperture and the panel aperture, thereby permitting air/water to drain out of the air mattress.

2. The inflatable structure of claim 1, wherein the first and second ends of the elongate sheet taper inwardly.

3. The inflatable structure of claim 1, wherein the first pair of opposing edges of the panel and the side edges of the elongate sheet are each approximately parallel, such that the first pair of opposing edges guide the side edges when a user pulls the first or second ends of the elongate sheet.

4. A method for draining air and water from an inflatable structure, the method comprising the steps of:

providing an inflatable structure comprising an air mattress capable of sustaining an air pressure, the air mattress having a side wall;

cutting a mattress aperture through the side wall of the air mattress;

providing a panel having a first pair of opposing edges, a second pair of opposing edges, and a panel aperture through the panel;

fastening the first pair of opposing edges to the air mattress such that the panel aperture is positioned over the mattress aperture;

providing an elongate sheet having side edges that extend from a first end to a second end, the elongate sheet having a sheet aperture;

positioning the elongate sheet between the panel and the air mattress so that the elongate sheet may slide between a closed position wherein the sheet covers the mattress aperture to provide an airtight seal over the air mattress, and an open position wherein the sheet aperture is aligned with the mattress aperture and the panel aperture, thereby permitting air and water to drain out of the air mattress.

* * * * *